US010982352B2

(12) United States Patent
Corbellini

(10) Patent No.: US 10,982,352 B2
(45) Date of Patent: Apr. 20, 2021

(54) SPINNERET

(71) Applicant: NV MICHEL VAN DE WIELE, Kortrijk / Marke (BE)

(72) Inventor: Ermete Corbellini, Cosio Valtellino (IT)

(73) Assignee: NV MICHEL VAN DE WIELE

( * ) Notice: Subject to any disclaimer, the term of this patent is extended or adjusted under 35 U.S.C. 154(b) by 141 days.

(21) Appl. No.: 16/338,683

(22) PCT Filed: Sep. 25, 2017

(86) PCT No.: PCT/IB2017/055793
§ 371 (c)(1),
(2) Date: Apr. 1, 2019

(87) PCT Pub. No.: WO2018/060824
PCT Pub. Date: Apr. 5, 2018

(65) Prior Publication Data

US 2019/0249335 A1 Aug. 15, 2019

(30) Foreign Application Priority Data

Sep. 30, 2016 (BE) ..... 2016/5730

(51) Int. Cl.
*D01D 4/02* (2006.01)
*D01D 5/088* (2006.01)

(52) U.S. Cl.
CPC ..... *D01D 4/02* (2013.01); *D01D 5/088* (2013.01)

(58) Field of Classification Search
CPC ..... D01D 4/02; D01D 5/088; D01D 5/092
See application file for complete search history.

(56) References Cited

U.S. PATENT DOCUMENTS 3,457,341 A * 7/1969 Duncan ..... D01D 5/253 264/177.13
4,248,581 A 2/1981 Harrison
2014/0103556 A1 4/2014 Diaz De Leon Izquierdo

FOREIGN PATENT DOCUMENTS

JP S56 107005 A 8/1981
JP H07 2469 A 1/1995
JP 2001 234425 A 8/2001

OTHER PUBLICATIONS

International Search Report and Written Opinion dated Dec. 19, 2017.

* cited by examiner

*Primary Examiner* — Xiao S Zhao
*Assistant Examiner* — Joseph S Leyson
(74) *Attorney, Agent, or Firm* — Fresh IP PLC; Clifford D. Hyra; Aubrey Y. Chen

(57) ABSTRACT

A spinneret (1) for producing several filaments, comprising a plurality of perforations (2), each of which ends on the bottom side of the spinneret (1) into a respective outlet opening (3) for pressing a thermoplastic there through for forming the filaments, wherein the outlet openings (3) are arranged in rows (5) which extend along a cooling direction (A), from one side of the spinneret (1) to the opposite side, wherein these rows (5) are arranged increasingly close together, away from a line (C), along this cooling direction (A) and through the centre of the spinneret (1).

14 Claims, 3 Drawing Sheets

SPINNERET

This application is a national phase entry under 35 U.S.C. § 371 of PCT International Application Number PCT/IB2017/055793, which claims the benefit of Belgian patent application number BE-2016/5730, filed Sep. 30, 2016, each of which is hereby incorporated by reference herein in its entirety.

FIELD OF THE DISCLOSURE

The present disclosure relates to a spinneret for producing several filaments, comprising a plurality of perforations, each of which ends on the bottom side of the spinneret into a respective outlet opening for pressing a thermoplastic there through for forming the filaments, wherein the outlet openings are arranged in rows which extend along a cooling direction, from one side of the spinneret to the opposite side.

Such spinnerets are used in an extrusion process for melt-spinning filaments. In such an extrusion process, typically, a thermoplastic which has been melted by means of an extruder, such as polypropylene, polyester or polyamide, is pressed through one or several such spinnerets to form filaments. Each spinneret is provided with a plurality of perforations, each having an access opening on the top side of the spinneret, via which the plastic is provided in the perforation and an outlet opening on the bottom side of the spinneret, through which the plastic pressed through the perforation leaves the spinneret as a filament. Thus, one or several filament bundles are formed for each spinneret.

The shape of a spinneret may be rectangular. The perforation pattern may then be rectangular, circular or arcuate or may assume any intermediate pattern. A spinneret may also be circular. In the latter case, the perforation pattern is thus also substantially arranged in a circle.

The present disclosure relates to such spinnerets which are used in an extrusion process, wherein the filaments which are formed by these spinnerets are cooled by means of what is referred to as transverse cooling. In this case, air is blown from one side of the filament bundle(s) formed by a spinneret at right angles to this (these) filament bundle(s). In this case, the air substantially follows a cooling direction which is directed from one side of the spinneret to an opposite side of the spinneret. At the location of the filaments, the air will be deflected locally.

BACKGROUND

With such existing spinnerets, the outlet openings are conventionally arranged in rows, wherein the rows are tilted with respect to said cooling direction, so that the air can impinge on each filament to the greatest degree. However, if the number of perforations per spinneret is increased in such an arrangement, the air will no longer be able to reach all the filaments formed thereby, but be deflected around the filament bundle, so that the filaments are cooled to an insufficient degree.

There already exist such optimized spinnerets in which the outlet openings are arranged in slightly curved rows which are substantially directed along the cooling direction, so that all filaments can again be impinged by cooling air in the case of a relatively large number of filaments formed thereby. However, also with this variant of a spinneret, the limit of the number of outlet openings per spinneret has been reached. If the number of outlet openings were to be increased further, the filaments would be cooled to an insufficient degree and/or they would start to stick together.

SUMMARY

It is an object of the present invention in some embodiments to provide an alternative spinneret, which can be provided with more perforations than the known spinnerets, without having to compromise on cooling of the filaments and without the filaments sticking to each other.

This object of the invention may be achieved by providing a spinneret for producing several filaments, comprising a plurality of perforations, each of which ends on the bottom side of the spinneret into a respective outlet opening for pressing a thermoplastic there through for forming the filaments, wherein the outlet openings are arranged in rows which extend along a cooling direction, from one side of the spinneret to the opposite side, wherein these rows are arranged increasingly close together, away from a line, along this cooling direction and through the centre of the spinneret.

When fitting this spinneret in an extrusion device for forming filaments, said cooling direction will coincide with the direction in which air is blown by means of a cooling device to cool the formed filaments.

Since the outlet openings are arranged in rows along this cooling direction, more outlet openings per spinneret may be provided, in which case the cooling air can still reach all filaments formed thereby, without the air flow being deflected around the filament bundle. Just as with the optimised prior-art spinnerets, these rows may be slightly curved, but preferably they are arranged in straight lines.

By arranging the rows increasingly close together away from the centre of the spinneret, the density of the outlet openings further from the centre of the spinneret is greater than closer to the centre of the spinneret, viewed at right angles to the cooling direction. Thus, the cooling air can reach as many outlet openings as possible to a maximum degree. In this way, a large filament mass can be cooled in an efficient manner. The plastic mass is distributed as well as possible across the entire surface area of the spinneret.

By means of an arrangement of the outlet openings according to some embodiments of the present invention, it is now possible to provide around 255 outlet openings on the same surface area of a spinneret on which commonly around 72 outlet openings were provided and on which, according to the optimized arrangement, around 181 outlet openings were provided, without compromising the cooling of the various filaments and without the filaments sticking to each other.

In order to be able to use the cooling air to the maximum degree for cooling the filaments, the distance between successive rows is preferably at most 5 times the diameter of each perforation. The diameter of such a perforation is assumed to be the diameter of the smallest circumscribed cylinder thereof.

The distance between successive rows is furthermore preferably at most 3 times the diameter of each perforation and still more preferably at most 2.5 times this diameter. In addition, this distance is preferably at least 1.25 times the diameter of each perforation and still more preferably at least 1.5 times this diameter.

In this way, cooling air can flow between these rows, with the cooling power of the air flow still being used to cool the filaments.

In a further optimized spinneret according to some embodiments of the present invention, the outlet openings of each row are arranged increasingly far apart, viewed along the cooling direction, in order to be able to cool all filaments as efficiently as possible.

The outlet openings may furthermore also be arranged in curved lines in order to optimize cooling.

In a specific embodiment of a spinneret according to the present invention, the outlet openings are arranged in circular arches, with more than two outlet openings per circular arch.

More specifically, the circles of these circular arches then preferably have a common tangential tangent.

This common tangential tangent then preferably extends at right angles to the cooling direction.

Furthermore, this common tangential tangent is preferably arranged behind the spinneret, viewed along the cooling direction. Alternatively, but less preferably, this common tangential tangent may also be arranged in front of the spinneret, viewed along the cooling direction.

In an embodiment of a spinneret according to the present invention in which the outlet openings are arranged in circular arches, these circular arches preferably have an increasingly small diameter, viewed along the cooling direction.

The exit openings of a spinneret according to some embodiments of the present invention may have different shapes. The shape of each outlet opening will determine the shape of the filament which is formed thereby. If such an outlet opening is, more specifically, three-lobed, then a lobe of this outlet opening is preferably arranged counter to the cooling direction in order to cool such a filament to the maximum degree.

Each perforation of a spinneret opens in an access opening on the top side of the spinneret. Towards the outlet opening, each perforation adjacent to the access opening is preferably conical in order to allow plastic to flow into each perforation to the maximum degree.

In order to optimize the flow of air through a filament bundle formed using a spinneret according to the present invention, the outlet openings in successive rows are preferably arranged offset with respect to each other, still more preferably staggered with respect to each other.

A spinneret according to the present invention is preferably circular.

The outlet openings are preferably arranged substantially inside a circle.

BRIEF DESCRIPTION OF THE DRAWINGS

The present invention will now be explained in more detail by means of the following detailed description of a preferred embodiment of a spinneret according to the present invention. The sole aim of this description is to give illustrative examples and to indicate further advantages and particulars of the invention and can thus not be interpreted as a limitation of the area of application of the invention or of the patent rights defined in the claims.

In this detailed description, reference numerals are used to refer to the attached drawings, in which.

DETAILED DESCRIPTION

Figure 1:
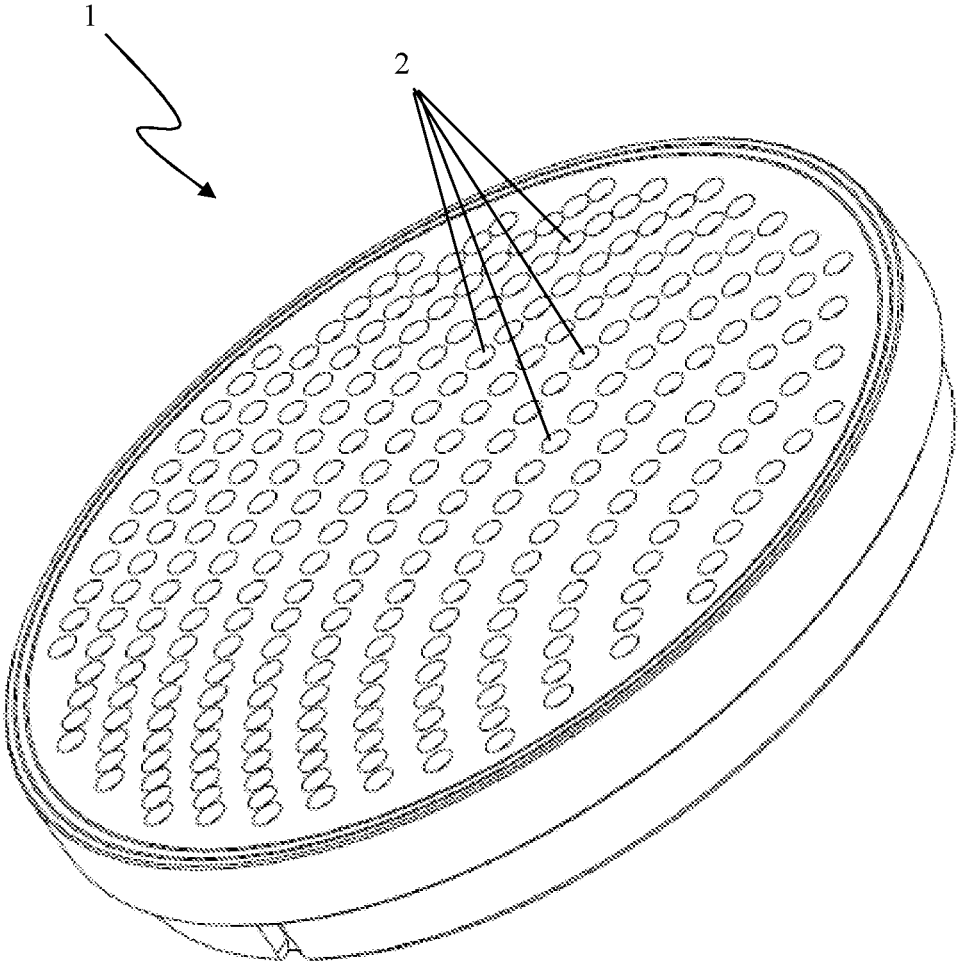
FIG. 1 shows a spinneret according to the present invention in perspective from above.
Figure 2:
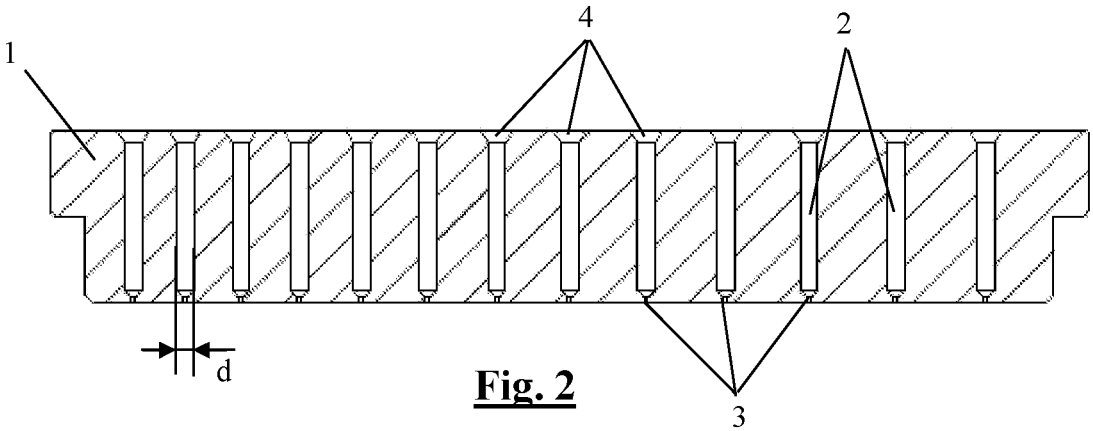
FIG. 2 shows the spinneret from FIG. 1 in cross section.
Figure 3:
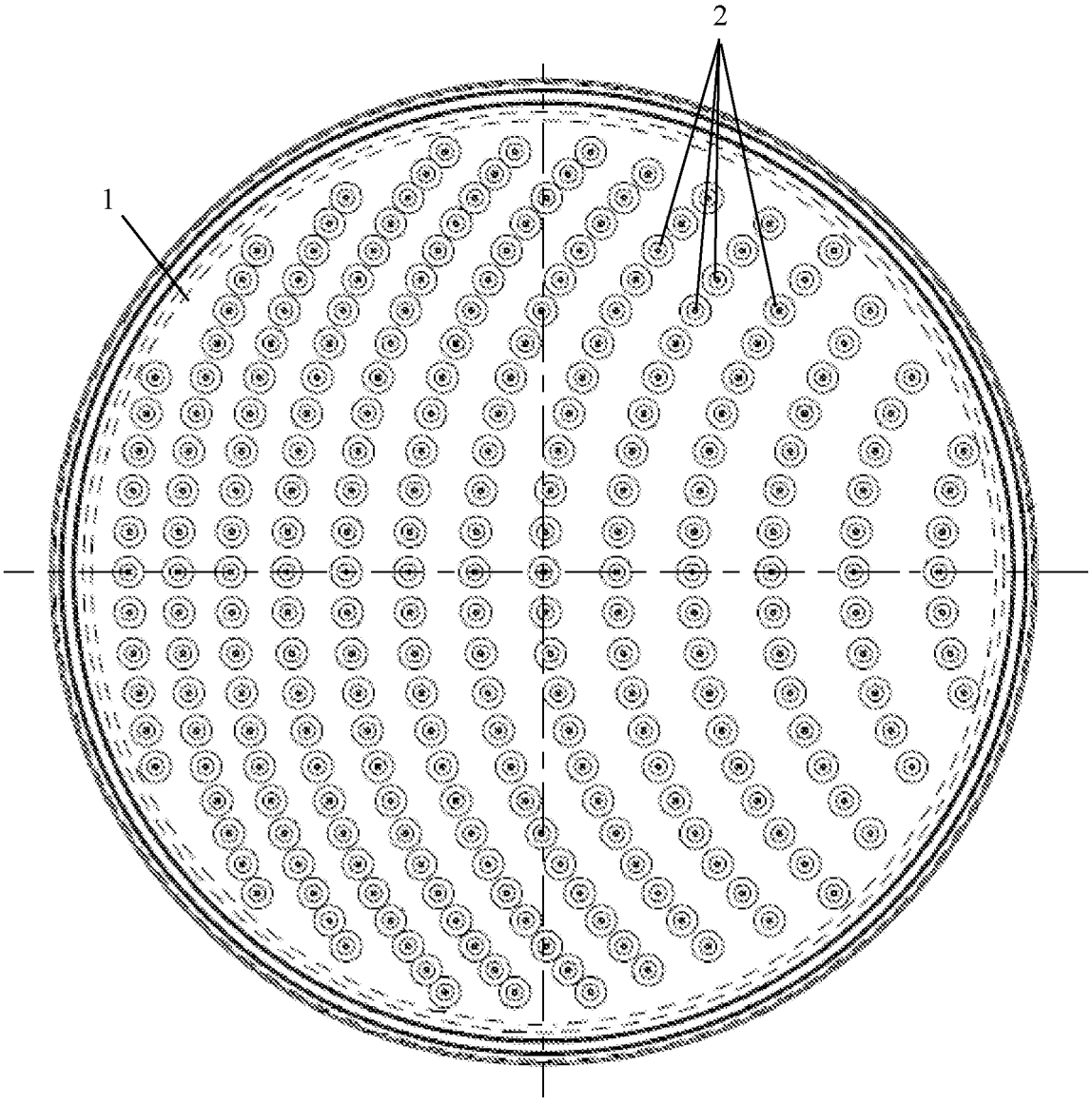
FIG. 3 shows the spinneret from FIG. 1 in top view.

The embodiment of a spinneret (1) according to the invention illustrated in the figures is circular and comprises 255 perforations (2). As can be seen in FIG. 2, each perforation (2) extends through the spinneret (1) from an access opening (4) on the top side of the spinneret (1) to an outlet opening (3) at the bottom side of the spinneret (1). The outlet openings (3) are arranged substantially inside a circle.

Figure 4:
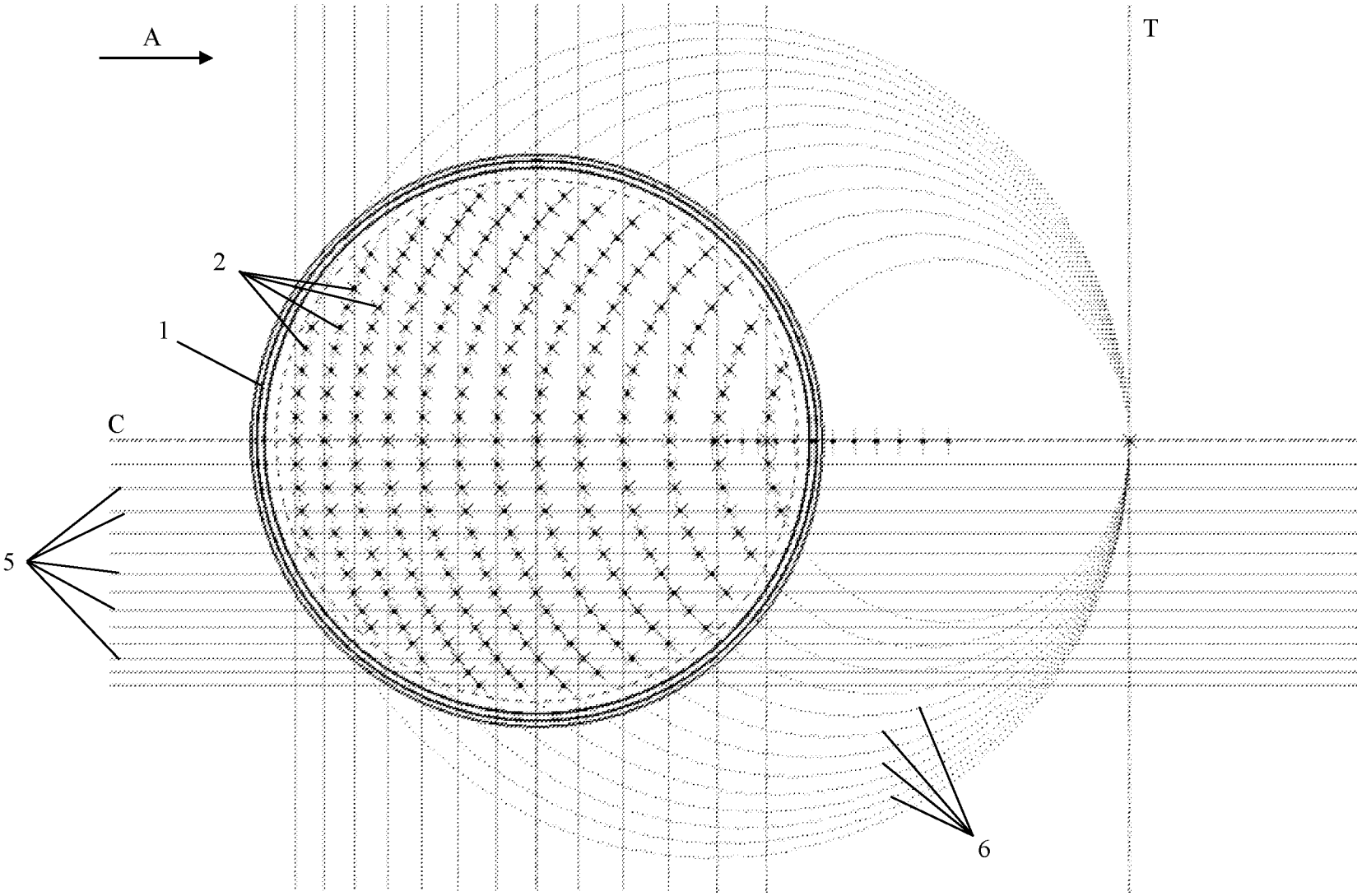
FIG. 4 diagrammatically shows the rows and circles in which the outlet openings are arranged in a view of the spinneret from FIG. 1.

In order to form filaments, a thermoplastic, such as polypropylene, polyester or polyamide, is pressed through these perforations (2) from the top side in order to leave the spinneret (1) on the bottom side as filaments. In order to cool these filaments, air is blown onto these filaments along the cooling direction (A), which is indicated in FIG. 4. Due to the positioning of the outlet openings (3), these filaments are cooled in an optimum manner.

In FIG. 4, the outlet openings (3) are diagrammatically indicated on the spinneret (1) by means of crosses in order to illustrate their position on the spinneret (1).

These outlet openings (3) are arranged in rows (5). The horizontal lines (5) in FIG. 4 indicate these rows (5) for half the spinneret (1) on one side of line (C) along the cooling direction (A) and through the centre of the spinneret (1). Thus, it can be seen more clearly that the further these lines (5) are situated from line (C) running through the centre of the spinneret (1), the closer together these lines (5) are arranged. The illustrated spinneret (1) is symmetrical with respect to line (C) running through the centre of the spinneret (1), so that the outlet openings (3) on the other half of the spinneret (1) are arranged in corresponding rows (5) (not shown).

The diameter (d) of the perforations (2) of the illustrated spinneret (1) is 2 mm. The greatest distance between two successive rows (5) is 4.9 mm.

Vertical lines (7) through the outlet openings (3) on the line (C) through the centre of the spinneret (1) furthermore illustrate in FIG. 4 that the outlet openings (3) of the illustrated spinneret (1) on each row (5) are arranged increasingly far apart, viewed in the cooling direction (A). The greatest distance between two such successive vertical lines (7) in the illustrated embodiment is 10.4 mm.

In addition, it can be seen that the outlet openings (3) of the illustrated spinneret (1) are arranged on circular arches, the circles (6) of which are shown in FIG. 4. These circles (6) have a common tangential tangent (T) which is arranged behind the spinneret (1), viewed along the cooling direction (A), and extends at right angles to the cooling direction (A). These circles (6) have an increasingly small diameter, viewed along the cooling direction (A).

In addition, due to the position of the outlet openings (3) in said rows (5) and on said circular arches, it is ensured that the outlet openings (3) in successive rows (5) are arranged offset with respect to each other.

The invention claimed is:

1. Spinneret for producing several filaments, comprising a plurality of perforations, each of which ends on a bottom side of the spinneret into a respective outlet opening for pressing a thermoplastic therethrough for forming the filaments, wherein the outlet openings are arranged in rows which extend along a cooling direction, from one side of the spinneret to the opposite side, wherein these rows are arranged increasingly close together, away from a line, along this cooling direction and through a center of the spinneret, wherein the outlet openings in each row of the spinneret are arranged increasingly far apart when viewed along the cooling direction for an entire length of the spinneret from the one side of the spinneret to the opposite side.

2. Spinneret according to claim 1, characterized in that a distance between successive rows is at most 5 times a diameter of each perforation.

3. Spinneret according to claim 2, characterized in that the distance between successive rows is at most 3 times the diameter of each perforation.

4. Spinneret according to claim 3, characterized in that the distance between successive rows is at most 2.5 times the diameter of each perforation.

5. Spinneret according to claim 2, characterized in that the distance between successive rows is at least 1.25 times the diameter of each perforation.

6. Spinneret according to claim 2, characterized in that the distance between successive rows is at least 1.5 times the diameter of each perforation.

7. Spinneret according to claim 1, characterized in that the outlet openings are arranged in circular arches, with more than two outlet openings per circular arch.

8. Spinneret according to claim 7, characterized in that the circles of the circular arches have a common tangential tangent.

9. Spinneret according to claim 8, characterized in that the tangential tangent is arranged behind the spinneret, viewed along the cooling direction.

10. Spinneret according to claim 8, characterized in that the tangential tangent extends at right angles to the cooling direction.

11. Spinneret according to claim 7, characterized in that the circular arches have an increasingly small diameter, viewed along the cooling direction.

12. Spinneret according to claim 1, characterized in that each outlet opening is three-lobed, wherein a lobe of this outlet opening is arranged counter to the cooling direction.

13. Spinneret according to claim 1, characterized in that the outlet openings in successive rows are arranged offset with respect to each other.

14. Spinneret according to claim 1, characterized in that this spinneret is circular.

* * * * *